US011389852B2

(12) United States Patent
Schleich et al.

(10) Patent No.: US 11,389,852 B2
(45) Date of Patent: Jul. 19, 2022

(54) FORMING TOOL

(71) Applicant: VOESTALPINE AUTOMOTIVE COMPONENTS DEUTSCHLAND GMBH, Dettingen an der Erms (DE)

(72) Inventors: Ralf Schleich, Waldenbuch (DE); Claus Eisinger, Neuffen (DE)

(73) Assignee: voestalpine Automotive Components Dettingen GmbH & Co. KG, Dettingen an der Erms (DE)

( * ) Notice: Subject to any disclaimer, the term of this patent is extended or adjusted under 35 U.S.C. 154(b) by 69 days.

(21) Appl. No.: 16/067,607

(22) PCT Filed: Dec. 23, 2016

(86) PCT No.: PCT/EP2016/082601
§ 371 (c)(1),
(2) Date: Jun. 30, 2018

(87) PCT Pub. No.: WO2017/114790
PCT Pub. Date: Jul. 6, 2017

(65) Prior Publication Data

US 2019/0009322 A1 Jan. 10, 2019

(30) Foreign Application Priority Data

Dec. 30, 2015 (EP) ..... 15203211

(51) Int. Cl.
*B21D 24/04* (2006.01)
*B21D 22/22* (2006.01)

(52) U.S. Cl.
CPC ..... *B21D 24/04* (2013.01); *B21D 22/22* (2013.01)

(58) Field of Classification Search
CPC ..... B21D 24/04; B21D 24/08; B21D 24/06; B21D 24/10; B21D 24/12; B21D 24/14;
(Continued)

(56) References Cited

U.S. PATENT DOCUMENTS

2006/0101888 A1* 5/2006 Kitamura ..... B21D 24/02 72/350
2014/0007640 A1* 1/2014 Endo ..... B21C 23/183 72/352
(Continued)

FOREIGN PATENT DOCUMENTS

DE 102004059598 A1 6/2006
DE 102009028769 A1 * 2/2011 ..... B21D 24/04
(Continued)

OTHER PUBLICATIONS

Machine Translation of DE-102011116714-A1, Kotzian et al., Publication Year 2013, Total pp. 17 (Year: 2020).*
(Continued)

*Primary Examiner* — Teresa M Ekiert
*Assistant Examiner* — Sarkis A Aktavoukian

(57) ABSTRACT

A forming tool for forming a metal sheet, having an upper tool part and a movable sheet holder that is supported against the lower tool part, and having a locking device, which is provided between the sheet holder and a hold-down and has at least one spacer element that is supported so that it is able to move from a rest position into a working position as a function of a relative movement, which occurs during the closing of the forming tool. The forming tool also has a wedge drive with a slider and a driver, the slider that is equipped with the spacer element is supported so that it is able to move in contact with the driver as a function of the relative movement that occurs between the sheet holder and the upper tool part during the closing of the forming tool, in order to move the spacer element into its working position.

7 Claims, 4 Drawing Sheets

(58) Field of Classification Search
CPC ..... B21D 24/16; B21D 22/22; B21D 28/325; B21D 19/082; B21D 22/02; B21D 22/04; B21D 22/06; B21D 25/02; B21D 28/32; B21D 37/08; B30B 7/026; B30B 1/40; B30B 15/287; B30B 15/288
USPC ..... 100/219; 72/482.3, 482.1, 481.1
See application file for complete search history.

(56) References Cited

U.S. PATENT DOCUMENTS

| | | | | |
|---|---|---|---|---|
| 2015/0336619 | A1* | 11/2015 | Tanaka | B21D 22/26 296/193.06 |
| 2016/0271682 | A1* | 9/2016 | Tanaka | B21D 22/26 |

FOREIGN PATENT DOCUMENTS

| | | | | |
|---|---|---|---|---|
| DE | 102011116714 | A1 * | 4/2013 | B21D 22/022 |
| DE | 102011120789 | A1 | 6/2013 | |
| EP | 2754509 | A1 * | 7/2014 | B21D 24/04 |
| FR | 2646623 | A1 | 11/1990 | |
| FR | 3021239 | A1 * | 11/2015 | B21D 28/32 |
| FR | 3047680 | A1 * | 8/2017 | B21D 22/22 |
| JP | H1085850 | A * | 4/1998 | |

OTHER PUBLICATIONS

Machine Translation of DE-102009028769-A1, Pflitsch, Publication Year 2011, Total Pages 13 (Year: 2020).*

* cited by examiner

FORMING TOOL

FIELD OF THE INVENTION

The invention relates to a forming tool, having a first tool part, which has an upper tool part and a die with a movably used hold-down that is supported against the upper tool part by means of a first pressing means, having a second tool part, which has a lower tool part, a punch that cooperates with the die for the forming, and a movable sheet holder that is supported against the lower tool part by means of a second pressing means, and having a locking device, which is provided between the sheet holder and the hold-down and has at least one spacer element that is supported so that it is able to move from a rest position into a working position as a function of a relative movement, which occurs during the closing of the forming tool, which establishes the distance between the sheet holder and the hold-down during the opening of the forming tool.

BACKGROUND OF THE INVENTION

In order to lock the hold-down and the sheet holder to each other and to establish their distance from each other during an opening of a forming tool, the prior art has disclosed providing a locking device, which, during the closing of the forming tool, swivels a spacer element embodied in the form of a tilting lever into position between the hold-down and the sheet holder. This locking measure makes it possible to compensate in a particular way for a difference in the pressing force of the two pressing means, for example gas pressure springs—in an attempt to prevent undesirable relative movement between the hold-down and the sheet holder during the opening of the forming tool. In this regard, it is thus possible to reduce a negative impact on the forming quality. This solution of the locking device has the disadvantage, among others, of requiring a comparatively massive embodiment because of the leverage on the tilting lever, which is why such locking devices are unsuitable for tools with that are subjected to comparatively high loads. In addition, such locking devices from the prior art are comparatively complex in their control and structural design—and are therefore cost-intensive to manufacture and maintain.

The object of the invention, therefore, based on the forming tool of the above-explained prior art, is to simplify this forming tool with regard to the design complexity and to ensure high durability. In addition, this embodiment should also be suitable for high loads.

SUMMARY OF THE INVENTION

The invention attains the stated object in that the locking device has at least one wedge drive with a slider and driver, the slider that is equipped with the spacer element being supported so that it is able to move in contact with the driver as a function of the relative movement that occurs between the sheet holder and the upper tool part during the closing of the forming tool in order to move the spacer element into its working position.

If the locking device has at least one wedge drive with a slider and driver, then the force-deflecting function that is known from wedge drives can be used to simply actuate the locking device if the slider that is equipped with the spacer element is supported so that it is able to move in contact with the driver as a function of the relative movement that occurs between the sheet holder and the upper tool part during the closing of the forming tool in order to move the spacer element into its working position. In addition, a wedge drive can be embodied as comparatively robust in comparison to an axially supported tilting lever from the prior art, making it possible to transfer even high loads. In this way, it is also possible, for example, to use gas pressure springs as pressing means. On the locking device according to the invention, the wedge drive can firmly establish the distance between the sheet holder and the hold-down. The invention therefore provides a forming tool, which can be used even under high loads and always enables a high forming quality.

In general, it should be noted that the forming tool can be a deep-drawing tool for tensile/compressive forming according to DIN 8584. It should also be mentioned that this forming tool can be used to form a sheet, a sheet blank (metal sheet blank), or a tailored blank.

In order to reliably establish the distance between the sheet holder and the hold-down, the spacer element—in its working position—can form a stop for the hold-down and/or sheet holder. In addition, this comparatively rugged mechanical embodiment can further improve the durability of the forming tool.

If the hold-down has a shoulder that protrudes radially from the die and forms a counterpart stop for the stop of the spacer element, then the design of the forming tool can be simplified further. In addition, this allows the locking device to be provided outside of the tool parts that cooperate in the forming—thus making it possible to achieve a simplification of the design and to avoid possible interfering contours on the forming tool.

The loads on the movable tool parts and more specifically on the upper tool part can be reduced if the driver is fastened to the upper tool part and the slider is supported so that it can slide on the sheet holder.

If the slider is supported so that it is able to move in contact with the driver in opposition to the action of a first spring, then after the opening of the forming tool, the slider—in a simply designed embodiment—can be guided back into its free rest position.

If the spacer element is supported on the slider so that it is able to slide in opposition to the action of a second spring, whose direction of action is oriented opposite from the direction of action of the first spring, then the spacer element can be moved into its working position in a prestressed fashion—which can increase the reliability of the operation of the locking device. In addition, this allows the spacer element to be moved into its working position chronologically offset from the movement of the slider, which can facilitate the adjustment of the wedge guide to the relative movement between the sheet holder and the upper tool part. This makes it possible to further simplify the design of the forming tool.

The manipulation of the forming tool—both when loading it with a sheet and when removing the formed sheet/formed blank—remains advantageously unimpaired by the locking device if the slider is supported so that it is able to move in such a way that in the working position of the spacer element, it assumes its position situated closest to the die. To be specific, the slider and spacer element together are removed again from the insertion and removal area between the two tool parts when the forming tool is open, thus preventing the locking device from producing any interfering contours on the forming tool. In addition, this makes it possible to protect the locking device in a simply designed way from damage due to the loading/removal of the sheet—which can contribute to further increasing the durability of the forming tool.

Design simplicity in the forming tool can be achieved if the first and second pressing means are embodied in the form of gas pressure springs.

BRIEF DESCRIPTION OF THE DRAWINGS

The subject of the invention is shown in greater detail by way of example in the form of an embodiment variant. In the drawings.

DETAILED DESCRIPTION OF THE PREFERRED EMBODIMENTS

Figure 1:
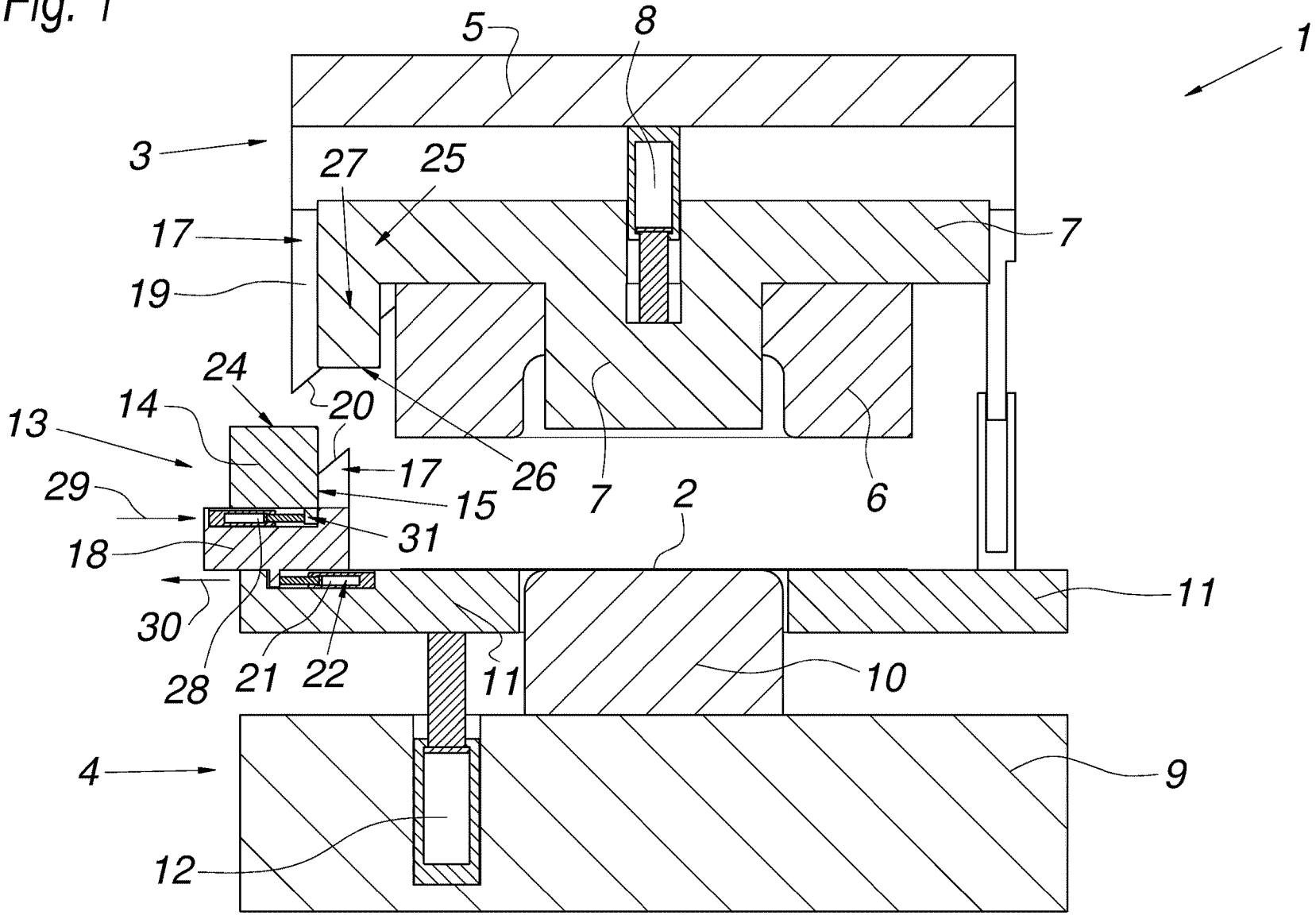
FIG. 1 shows a cut-away side view of an open forming tool with a sheet blank inserted.

The forming tool 1, which is depicted as a simply functioning press by way of example in FIGS. 1 through 4, is used for deep drawing a sheet, a sheet blank (metal sheet blank), and/or a tailored blank. In FIG. 1, this forming tool 1 is in its open position in which the flat blank 2 to be formed has already been inserted. In this open position of the forming tool 1, a first tool part 3 and a second tool part 4 of the forming tool 1 are visible.

An upper tool part 5, a matrix 6, and a hold-down 7 belong to the first tool part 3. The hold-down 7 is supported against the upper tool part 5 by means of a first pressing means 8, which in the exemplary embodiment is embodied in the form of a first gas pressure spring 108—see FIG. 3 with regard to the latter. The matrix 6 is rigidly connected to the upper tool part 5.

A lower tool part 9, a die 10, and a sheet holder 11 belong to the second tool part 4. The sheet holder 11 is supported against the lower tool part 9 by means of a second pressing means 12, which is embodied in the form of a second gas pressure spring 112—see FIG. 3 with regard to the latter. The forming tool 1 according to the invention therefore does not require any bottom air. The die 10 of the second tool part 4 is fastened to the lower tool part 9 and cooperates with the matrix 6 of the first tool part 3 to form the blank 2.

Figure 2:
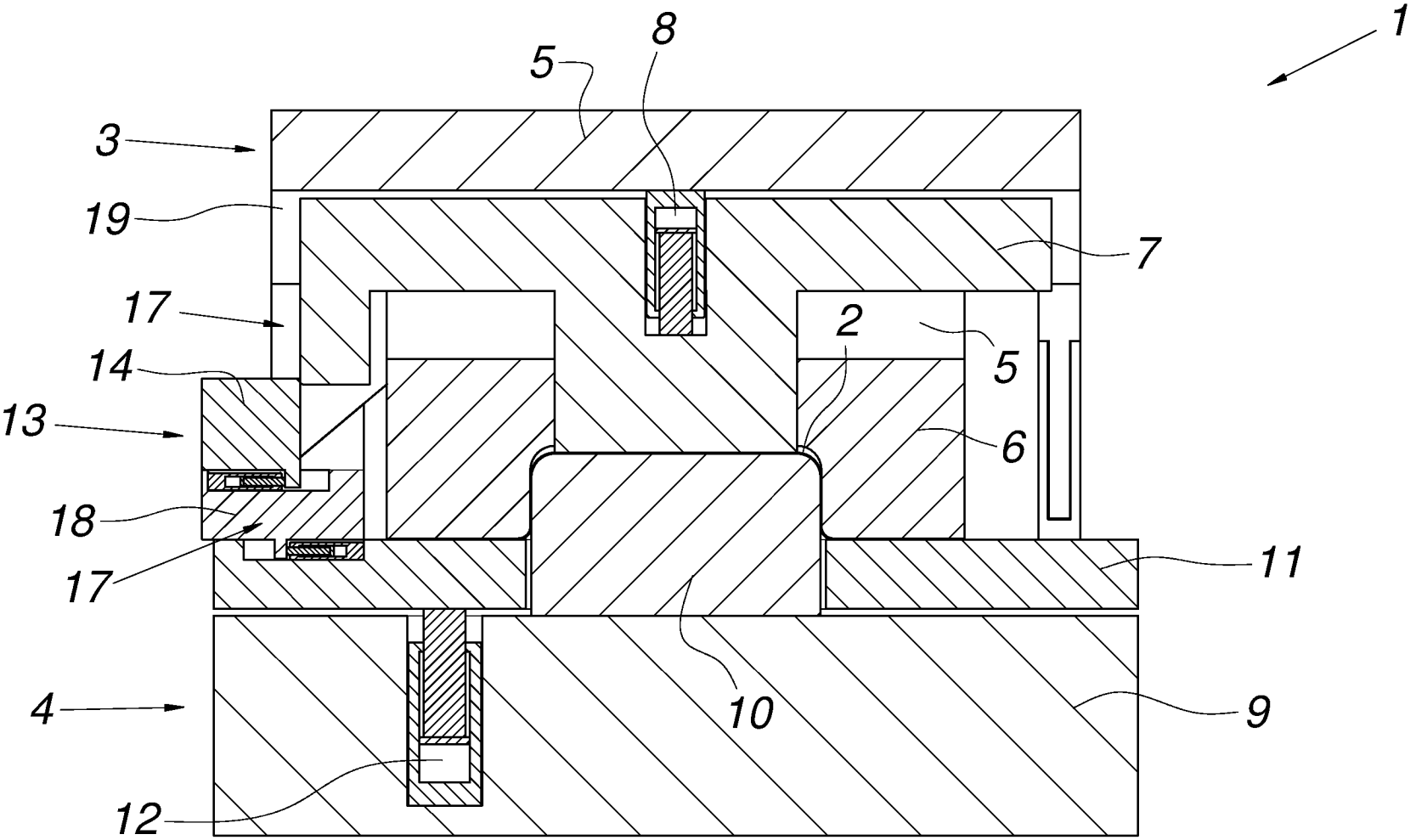
FIG. 2 shows the forming tool in a partially closed position.

The forming tool 1 also has a locking device 13, which is provided between the sheet holder 11 and the hold-down 7. The locking device 13 includes a spacer element 14 with which the distance between the sheet holder 11 and the hold-down 7 can be established. This is necessary for the opening of the forming tool 1 in order, despite possibly different compressive forces of the first and second pressing means 8, 12, to ensure a high quality, e.g. in the formed blank 2. This locking device 13 is actuated by the closing movement of the forming tool 1, as shown in FIG. 2. When FIGS. 1 through 4 are considered in combination, it is clear that the spacer element 14 is supported so that it is able to move as a function of a relative movement, which occurs during the closing of the forming tool 1—specifically from a rest position 15 when the forming tool 1 is open according to FIG. 1 into a working position 16 according to FIG. 3—which establishes the distance between the sheet holder 11 and the hold-down 7 during the opening of the forming tool 1.

According to the invention, this movement of the spacer element 14 is implemented by a wedge drive 17, which belongs to the locking device 13. To accomplish this, the wedge drive 17 has a slider 18 and a driver 19, which form corresponding guide surfaces 20 on the wedge drive 17.

The slider 18 has the spacer element 14 and is supported in sliding fashion—namely on the sheet holder 11 in the exemplary embodiment. As a function of the relative movement that occurs between the sheet holder 11 and the upper tool part 5, the slider 18—in contact with the driver 19, which is fastened to the upper tool part 5 in the exemplary embodiment—is slid and thus moves the spacer element 14 under the hold-down 7, as a result of which the hold-down 7 strikes the spacer element 14 and thus the sheet holder 11. For this purpose, the spacer element 14 forms a stop 24 for the hold-down 7. This establishes the distance between the sheet holder 11 and the hold-down 7—in the exemplary embodiment, specifically by means of the height of the spacer element 14 and its vertical offset relative to the sheet holder 11, which vertical offset results from the position of the spacer element 14 on the slider 18.

In this way, a particularly rugged locking device 13 is achieved, which can reliably set the established distance between the sheet holder 11 and the hold-down 7, even under high loads. The forming tool 1 according to the invention therefore has a particularly high durability.

Figure 3:
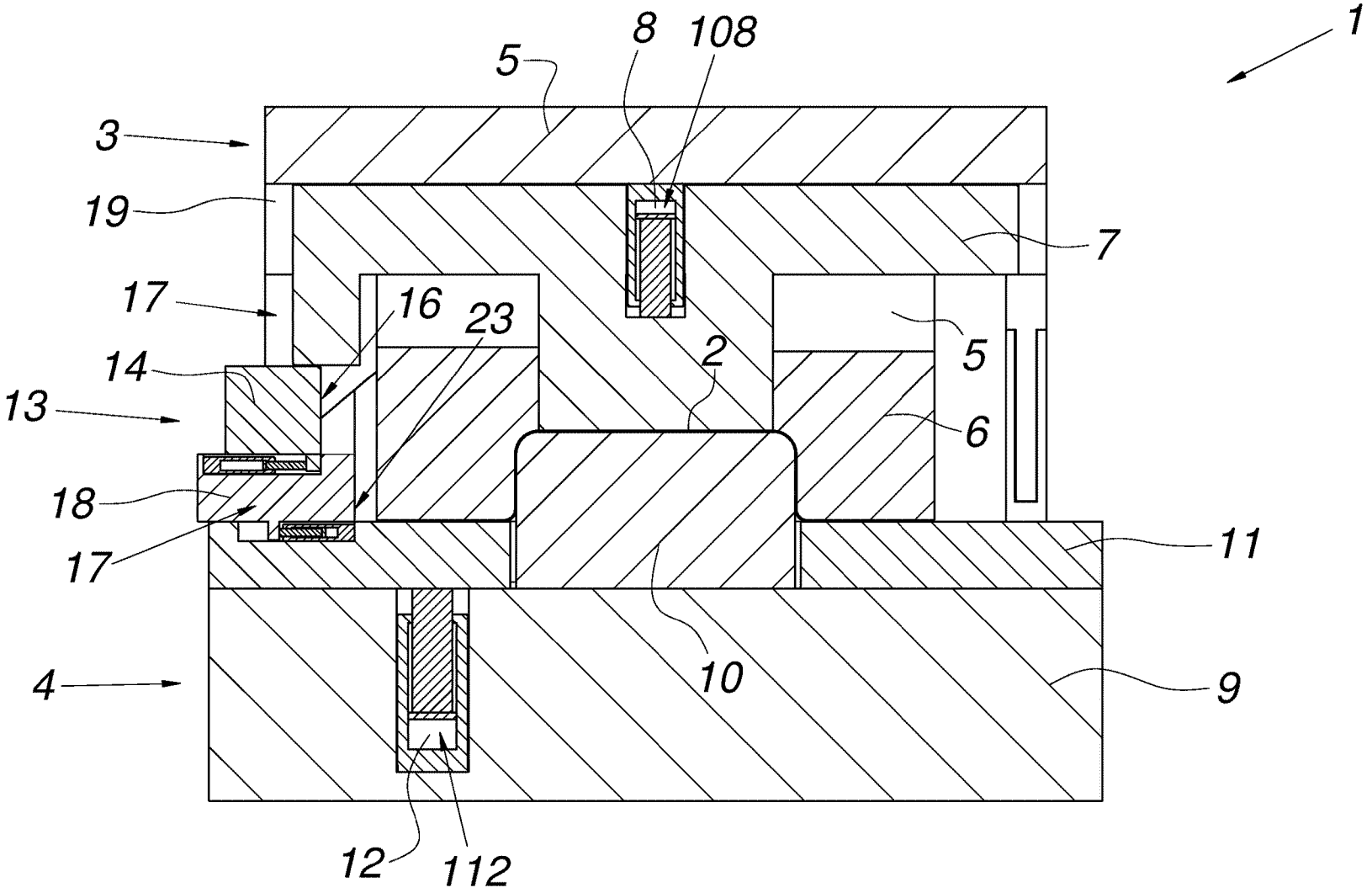
FIG. 3 shows the forming tool in a closed position.
Figure 4:
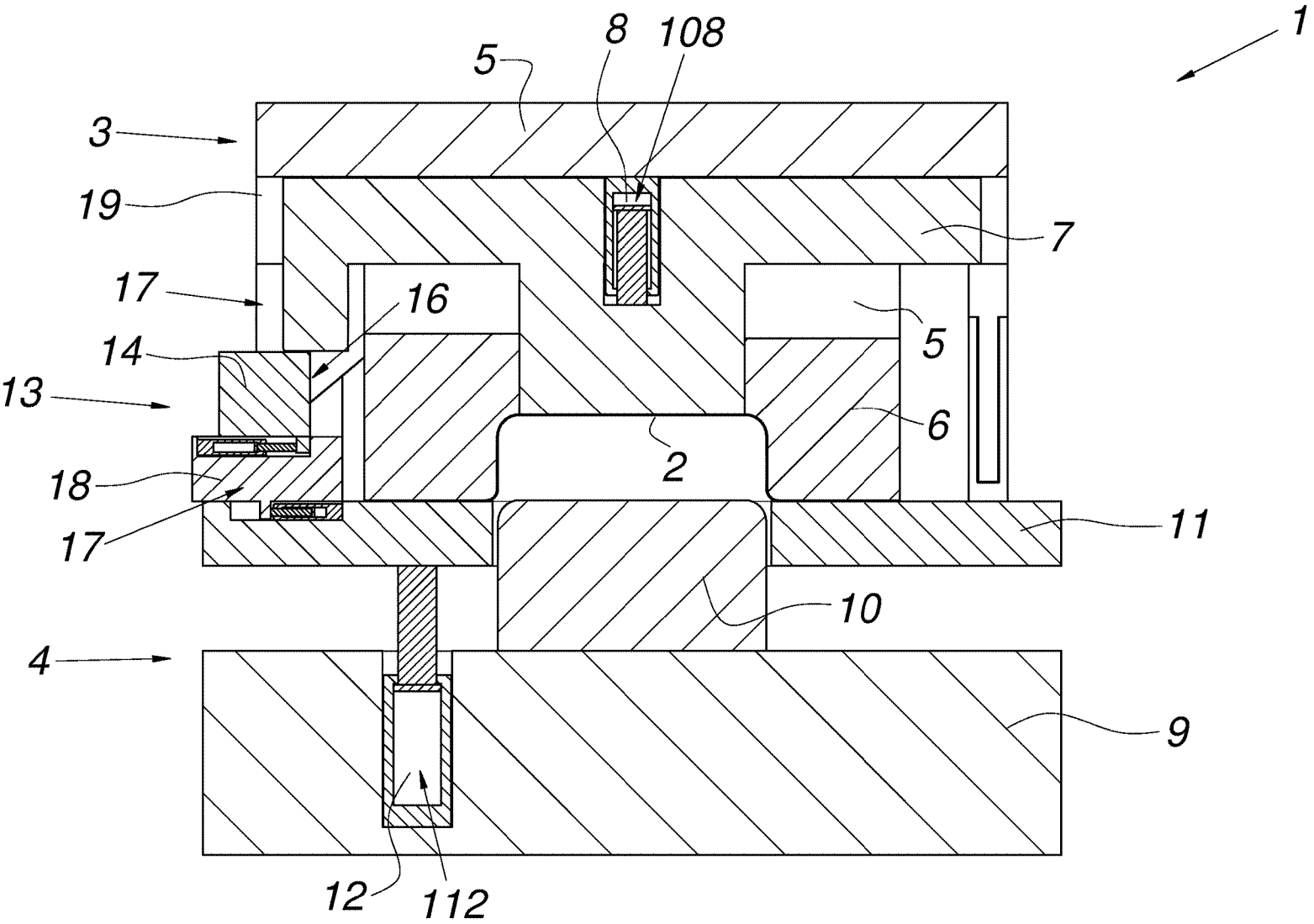
FIG. 4 shows the forming tool as it is being guided back into the open position.

As is also clear from FIG. 1, the slider 18 is supported so that it is able to move in contact with the driver in opposition to the action of a first spring 21, which is embodied in the form of a third gas pressure spring. This spring 21 acts between the slider 18 and the sheet holder 11 and pushes the slider 18 away from the die 6 along its first linear guide 22 on the sheet holder 11. As a result, in the working position 16 of the spacer element 14, the slider 18 comes into its position that is situated the closest to the die 6, which position 23 of the slider is shown in FIG. 3. In the rest position 15 of the spacer element 14, the slider 18 is positioned the farthest from the die 6. This prevents the occurrence of interfering contours during the loading of the forming tool 1.

It is also clear from FIG. 1 that the hold-down 7 forms a shoulder 25 that protrudes radially from the die 6 and forms a counterpart stop 26 for the stop 24 of the spacer element 14. This counterpart stop 26 is provided on the axially protruding section 27 of the radially protruding shoulder 25, which permits the spacer element 14 to be correspondingly embodied as reduced in height.

The spacer element 14 is supported on the slider 18 so that it is able to slide in opposition to the action of a second spring 28. This spring 21, which is embodied in the form of a fourth gas pressure spring, acts between the spacer element 14 and the slider 18 and loads the spacer element 14 along its second linear guide 31 on the slider 18 with a direction of action 29 that is oriented opposite from the direction of action 30 of the first spring 21. As a result, the spacer element 14 can be brought into its working position 16 in a prestressed fashion, which prestressing is visible in FIG. 2 based on the support of the spacer element 14 in opposition to the action of the second spring 28.

FIGS. 1 through 4 also clearly show that the first and second linear guides 22 and 31 extend parallel to each other.

In general, it should be noted—although this is not shown—that the slider 18 is also movably supported on the upper tool part 5 and the driver can be fastened to the sheet holder 11. In this case, the spacer element then also forms a stop 24 for the sheet holder 11 in order to establish the distance between the sheet holder 11 and the hold-down 7. It is also conceivable for the spacer element 14 to form a respective stop 24 for the sheet holder 11 and the hold-down 7 — but this is also not shown.

The invention claimed is:

1. A forming tool for forming a sheet material, comprising:

a first tool part, which has an upper tool part and a die with a movably inserted hold-down that is supported against the upper tool part by a first pressing device;

a second tool part, which has a lower tool part, a punch that cooperates with the die for forming the sheet material between a forming surface of the punch and a forming surface of the die, and a movable sheet holder that is supported against the lower tool part by a second pressing device, wherein the sheet holder cooperates with the die for holding the sheet material against the die, and the hold-down cooperates with the punch for holding the sheet material against the punch on the forming surface of the die;

a locking device comprising at least one spacer element and at least one wedge drive, wherein the locking device is provided between the sheet holder and the hold-down to define a distance between the sheet holder and the hold-down during an opening of the forming tool, wherein the at least one wedge drive has a slider and a driver and the driver is fastened to the upper tool part and the slider is slidably mounted on the sheet holder, and wherein the slider is equipped with the at least one spacer element, and the at least one spacer element is slidably mounted on the slider, and wherein the at least one spacer element is configured to move from a rest position into a working position as a function of a closing of the forming tool, and spacer element is configured to define the distance between the sheet holder and the hold-down during the opening of the forming tool; and wherein the slider in contact with the driver is configured to move the at least one spacer element into the working position as a function of a relative movement between the sheet holder and the upper tool part during the closing of the forming tool.

2. The forming tool according to claim 1, wherein the at least one spacer element in the working position forms a stop for the hold-down and/or the sheet holder in order to define the distance between the sheet holder and the hold-down.

3. The forming tool according to claim 2, wherein the hold-down has a shoulder that protrudes radially from the die and forms a counterpart stop for the stop of the at least one spacer element.

4. The forming tool according to claim 1, wherein the slider moves in contact with the driver in opposition to an action of a first spring.

5. The forming tool according to claim 4, wherein the at least one spacer element slides in opposition to an action of a second spring, a direction of the action of the second spring being opposite from a direction of the action of the first spring.

6. The forming tool according to claim 1, wherein the slider is positioned closest to the die when the at least one spacer element is in the working position.

7. The forming tool according to claim 1, wherein the first and second pressing devices are gas pressure springs.

* * * * *